US006875129B2

(12) United States Patent
Erickson et al.

(10) Patent No.: US 6,875,129 B2
(45) Date of Patent: Apr. 5, 2005

(54) GOLF CLUB HEAD

(75) Inventors: Joel B. Erickson, Carlsbad, CA (US); D. Clayton Evans, San Marcos, CA (US); Matthew T. Cackett, San Diego, CA (US); J. Andrew Galloway, Escondido, CA (US); Herbert Reyes, Laguna Niguel, CA (US); Alan Hocknell, Laguna Niguel, CA (US)

(73) Assignee: Callaway Golf Company, Carlsbad, CA (US)

( * ) Notice: Subject to any disclaimer, the term of this patent is extended or adjusted under 35 U.S.C. 154(b) by 40 days.

(21) Appl. No.: 10/250,106

(22) Filed: Jun. 4, 2003

(65) Prior Publication Data

US 2004/0248665 A1 Dec. 9, 2004

(51) Int. Cl.[7] ..... A63B 53/04; A63B 53/06
(52) U.S. Cl. ..... 473/345; 473/349
(58) Field of Search ..... 473/324–350

(56) References Cited

U.S. PATENT DOCUMENTS

| | | | | |
|---|---|---|---|---|
| 1,167,387 | A | | 1/1916 | Daniel |
| 1,638,916 | A | | 8/1927 | Butchart |
| 1,780,625 | A | | 4/1930 | Mattern |
| 2,750,194 | A | | 1/1956 | Clark |
| 3,692,306 | A | | 9/1972 | Glover |
| 3,897,066 | A | | 7/1975 | Belmont |
| 3,937,023 | A | | 2/1976 | Williamson |
| 3,970,236 | A | | 7/1976 | Rogers |
| 3,975,023 | A | | 8/1976 | Inamori |
| 4,021,047 | A | | 5/1977 | Mader |
| 4,398,965 | A | | 8/1983 | Campau |
| 4,535,990 | A | | 8/1985 | Yamada |
| 4,568,088 | A | | 2/1986 | Kurahashi |
| 4,762,322 | A | * | 8/1988 | Molitor et al. ..... 473/345 |
| 4,872,685 | A | | 10/1989 | Sun |
| 4,877,249 | A | | 10/1989 | Thompson |
| 5,024,437 | A | | 6/1991 | Anderson |
| 5,058,895 | A | * | 10/1991 | Igarashi ..... 473/341 |
| 5,094,383 | A | | 3/1992 | Anderson |
| 5,106,094 | A | | 4/1992 | Desbiolles et al. |
| 5,193,811 | A | | 3/1993 | Okumoto et al. |
| 5,228,615 | A | * | 7/1993 | Iijima et al. ..... 228/118 |
| 5,242,168 | A | | 9/1993 | Aizawa |
| 5,255,918 | A | | 10/1993 | Anderson |
| 5,261,663 | A | | 11/1993 | Anderson |
| 5,261,664 | A | | 11/1993 | Anderson |
| 5,282,624 | A | | 2/1994 | Viste |
| 5,310,185 | A | | 5/1994 | Viollaz et al. |
| 5,344,140 | A | | 9/1994 | Anderson |
| 5,346,216 | A | | 9/1994 | Aizawa |
| 5,377,986 | A | | 1/1995 | Viollaz et al. |
| 5,398,935 | A | | 3/1995 | Katayama |
| 5,410,798 | A | | 5/1995 | Lo |
| 5,425,538 | A | | 6/1995 | Vincent et al. |
| 5,465,968 | A | | 11/1995 | Aizawa |
| 5,499,814 | A | | 3/1996 | Lu |
| 5,516,107 | A | | 5/1996 | Okumoto et al. |
| 5,547,427 | A | | 8/1996 | Rigal et al. |

(Continued)

*Primary Examiner*—Gregory Vidovich
*Assistant Examiner*—Alvin A. Hunter, Jr.
(74) *Attorney, Agent, or Firm*—Michael A. Catania; Elaine H. Lo

(57) ABSTRACT

A golf club head (20) having a body (22) with a front wall (30) with an opening (32) and a striking plate insert (40) is disclosed herein. The body (22) is preferably composed of a light weight material such as a magnesium alloy or an aluminum alloy. A ribbon (28) of the body (22) has a recess (52) therein for placement of a rear weighting member (50). The golf club head (20) preferably has a volume between 300 cubic centimeters and 500 cubic centimeters. The golf club head (20) preferably has a mass between 105 grams and 300 grams.

12 Claims, 11 Drawing Sheets

U.S. PATENT DOCUMENTS 5,570,886 A 11/1996 Rigal et al.
5,624,331 A 4/1997 Lo et al.
5,743,813 A 4/1998 Chen et al.
5,776,011 A 7/1998 Su et al.
5,863,261 A 1/1999 Eggiman
6,146,571 A 11/2000 Vincent et al.
6,149,534 A 11/2000 Peters et al.
6,162,133 A * 12/2000 Peterson ..... 473/345
6,244,976 B1 * 6/2001 Murphy et al. ..... 473/305
6,247,636 B1 * 6/2001 Sun ..... 228/135
6,299,547 B1 * 10/2001 Kosmatka ..... 473/329
6,332,847 B2 * 12/2001 Murphy et al. ..... 473/324
6,371,868 B1 * 4/2002 Galloway et al. ..... 473/324
6,458,044 B1 * 10/2002 Vincent et al. ..... 473/334

* cited by examiner

GOLF CLUB HEAD

FEDERAL RESEARCH STATEMENT

[Not Applicable]

BACKGROUND OF INVENTION

1. Field of the Invention

The present invention relates to a golf club head with a metal striking plate insert. More specifically, the present invention relates to a golf club head with a light-weight body and a metal striking plate insert.

2. Description of the Related Art

When a golf club head strikes a golf ball, large impacts are produced that load the club head face and the golf ball. Most of the energy is transferred from the club head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent, which are on the order of 10–100 times larger than the damping properties of a metallic club face. Thus, during impact most of the energy is lost as a result of the high stresses and deformations of the golf ball (0.01 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate With a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a Golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLARÂ®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Anderson, U.S. Pat. No. 5,344,140, for a Golf Club Head And Method Of Forming Same, discloses the use of a hot forged material for the face plate. The face plate of Anderson may be composed of several hot forged metal materials including steel, copper and titanium. The hot forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduced structural weaknesses. Aizawa, U.S. Pat. No. 5,346,216 for a Golf Club Head, discloses a face plate having a curved ball hitting surface.

U.S. Pat. No. 6,146,571 to Vincent, et al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et a., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

Anderson, U.S. Pat. Nos. 5,024,437, 5,094,383, 5,255,918, 5,261,663 and 5,261,664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Aizawa, U.S. Pat. No. 5,242,168 discloses a golf club head having a fiber reinforced resin body with a thin metallic film layer.

Yamada, U.S. Pat. No. 4,535,990 discloses a golf club head having a fiber reinforced resin body with a face insert composed of a polycarbonate or like material.

Aizawa et al., U.S. Pat. No. 5,465,968 discloses a golf club head having a fiber reinforced resin body with a beryllium face plate.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of multiple material club heads, the prior art has failed to provide a multiple material club head with a high coefficient of restitution and greater forgiveness for the typical golfer.

SUMMARY OF INVENTION

One aspect of the present invention is a golf club head having a body composed of a light weight material, such as magnesium alloys or aluminum alloys, a metal striking plate insert, and a rear weighting member to provide a greater moment of inertia for the golf club head.

Another aspect of the present invention is a golf club head having a volume less than 450 cubic centimeters, a mass ranging from 190 grams to 225 grams, a moment of inertia about the Izz axis through the center of gravity of the golf club head greater than 3000 grams-centimeter squared, and a moment of inertia about the Iyy axis through the center of gravity of the golf club head greater than 1900 grams-centimeter squared.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
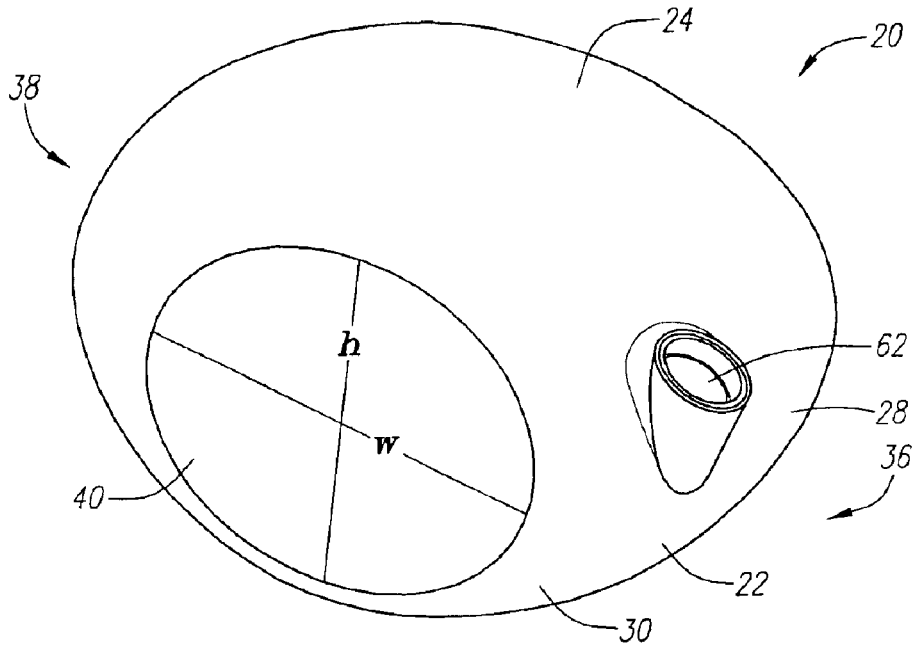
FIG. 1 is a front perspective view of a preferred embodiment of the golf club of the present invention.
Figure 2:
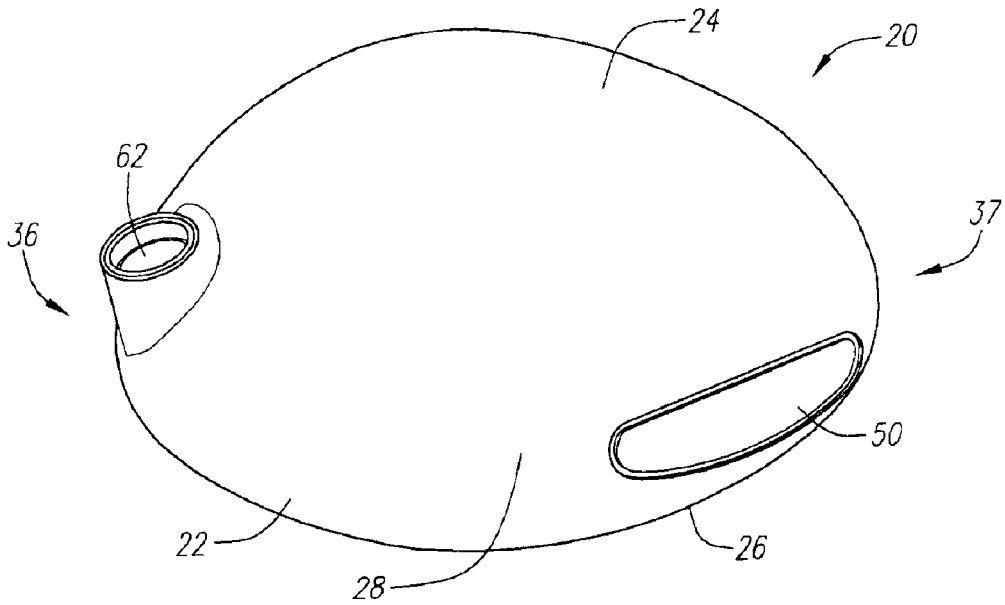
FIG. 2 is a rear perspective view of the golf club head of FIG. 1.

A preferred embodiment of a golf club head is generally designated 20 and shown in FIGS. 1–10. An alternative embodiment of a golf club head of the present invention is shown in FIGS. 11–19. The golf club head 20 preferably includes a full body 22, a striking plate insert 40 and a rear weighting member 50. The golf club head 20 of the present invention has a high moment of inertia about the center of gravity, "CG", for forgiveness, and a high coefficient of restitution to provide greater distance when striking a golf ball.

The full body 22 preferably has a crown 24, a sole 26, a ribbon 28, and a front wall 30 with an opening 32 and preferably a recessed portion 33. The ribbon 28 has an aft-recess 52 located preferably opposite of the striking plate insert 40. The body 22 preferably has a hollow interior 34, not shown. The golf club head 20 has a heel end 36, a toe end 38 an aft end 37. The full body 22 is preferably composed of a low density-metal material, preferably a magnesium alloy, aluminum alloy, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The full body 22 is preferably manufactured through metal-injection-molding. Alternatively, the full body 22 is manufactured through casting, forming, machining, powdered metal forming, electro chemical milling, and the like.

Alternatively, the full body 22 is composed of a non-metal material, preferably a composite material such as a continuous fiber pre-preg material (including thermosetting materials or thermoplastic materials for the resin). Other materials for the full body 22 include other thermosetting materials or other thermoplastic materials such as injectable plastics. The non-metal full body 22 is preferably manufactured through bladder-molding, resin transfer molding, resin infusion, injection molding, compression molding, or a similar process.

The striking plate insert 40 is attached to the full body 22 over the opening 32 of the front wall 30. Preferably the striking plate insert 40 is positioned over and attached to the recessed portion 33 of the front wall 30.

The striking plate insert 40 is preferably composed of a formed metal material. However alternatively, the striking plate insert 40 is composed of a machined metal material, a forged metal material, a cast metal material or the like. The striking plate insert 40 preferably is composed of a formed titanium or steel material. A preferred material is steel 4340 which is heat treated and then coated with a titanium nitride or a similar coating. Titanium materials useful for the striking plate insert 40 include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in *Calculations of Amorphous-Forming Composition Range For Ternary Alloy Systems And Analyses Of Stabilization Of Amorphous Phase And Amorphous-Forming Ability, Takeuchi and Inoue*, Materials Transactions, Vol. 42, No. 7, p 1435–1444 (2001), which pertinent parts are hereby incorporated by reference.

Preferably, a striking plate insert 40 composed of an amorphous metal that has a Young's modulus preferably in the range of 80 giga-Pascals ("GPa") to 120 GPa, and most preferably 90 GPa to 100 GPa. Such amorphous metals include Fe, Ni, Co and Cr based amorphous metals, which have a density ranging from 8 grams per cubic centimeters ("g/cc") to 10 g/cc. Other amorphous metals include Mg, Zr, Ti and Al based amorphous metals, which have a density ranging from 2 g/cc to 6 g/cc. Specific amorphous metals include: $Zr_{41.2}$ $Ti_{3.8}$ $Cu_{10}$ $Ni_{12.5}$ $Be_{22.5}$; $Zr_{60}$ $Al_{15}$ $Co_{2.5}$ $Ni_{7.5}$ $Cu_5$ (which has a hardness of 1360, a density of 6.5 g/cc and an elastic modulus of 91 GPa); $Fe_{72}$ $Al_5$ $Ga_2$ $P_{10}$ $C_6$ $B_4$ $Si_1$ (which has a hardness of 1250); $Cu_{60}$ $Zr_{30}$ $Ti_{10}$ (which has a hardness of approximately 700 and an elastic modulus of 112-134 GPa); $Cu_{60}$ $Hf_{30}$ $Ti_{10}$ (which has a hardness of approximately 700 and an elastic modulus of 112–134 GPa); and, $Mg_{80}$ $Cu_{10}$ $Y_{10}$ (which has a hardness of 220). Those skilled in the pertinent art will recognize that other amorphous metals may be used for the face component without departing from the scope and spirit of the present invention.

Methods such as vacuum die casting, permanent mold casting and hot forming sheet material for fabricating bulk articles from amorphous metals are known in the art and such methods may be used to fabricate the striking plate insert 40 of the present invention. Amorphous metal fabrication methods are disclosed in U.S. Pat. No. 5,797,443, U.S. Pat. No. 5,896,642, U.S. Pat. No. 5,711,363, and U.S. Pat. No. 6,021,840, which pertinent parts are hereby incorporated by reference.

In a preferred embodiment, the striking plate insert 40 has a thickness that ranges from 0.040 inch to 0.250 inch, more preferably a thickness of 0.080 inch to 0.120 inch, and is most preferably 0.108 inch for a titanium alloy striking plate insert 40, 0.090 inch for a stainless steel striking plate insert 40, and 0.075 inch for a striking plate insert composed of 4340 steel. In a preferred embodiment, the striking plate insert 40 has a uniform thickness. In an alternative embodiment, the striking plate insert has a variable face thickness such as disclosed in U.S. Pat. No. 5,803,824, U.S. Pat. No. 6,368,234, or U.S. Pat. No. 6,398,666, all of which are hereby incorporated by reference in their entirety. The exterior surface 40*a* of the striking plate insert 40 typically has a plurality of scorelines thereon.

The striking plate insert 40 is preferably co-molded with a body 22 or press-fitted into the opening subsequent to fabrication of the body 22. In another attachment process, the striking plate insert 40 is bonded to the recessed portion 33 of the front wall 30 using an adhesive. The adhesive is placed on the exterior surface of the recessed portion 33. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention. Yet in another attachment process, the body 22 is first bladder molded and then the striking plate insert 40 is mechanically secured to the body 22. Those skilled in the pertinent art will recognize other methods for attachment of the striking plate insert 40 to the body 22 without departing from the scope and spirit of the present invention.

The crown 24, the sole 26 and the ribbon 28 preferably range in thickness from 0.010 to 0.100 inch, more preferably from 0.025 inch to 0.070 inch, even more preferably from 0.028 inch to 0.040 inch, and most preferably have a thickness of 0.033 inch. The front wall 30 preferably has a thickness greater than the thickness of the crown 24, sole 26 or ribbon 28. The thickness of the front wall 30 preferably tapers from a maximum thickness at the opening 32 to a minimum thickness as the front wall 30 transitions to the crown 24, sole 26 and ribbon 28. In a preferred example, the front wall 30 has a thickness of 0.350 inch at the opening and tapers to a thickness of 0.033 inch at the crown 24, sole 26 and ribbon 28. The thickness of the front wall 30 preferably tapers to a minimum thickness along a transition region preferably having a distance of 0.50 inch to 1.0 inch. The maximum thickness of the front wall preferably ranges from 0.100 to 0.450 inch, more preferably from 0.250 inch to 0.400 inch, even more preferably from 0.300 inch to 0.375 inch, and most preferably the front wall 30 has a maximum thickness of 0.350 inch.

Figure 9:
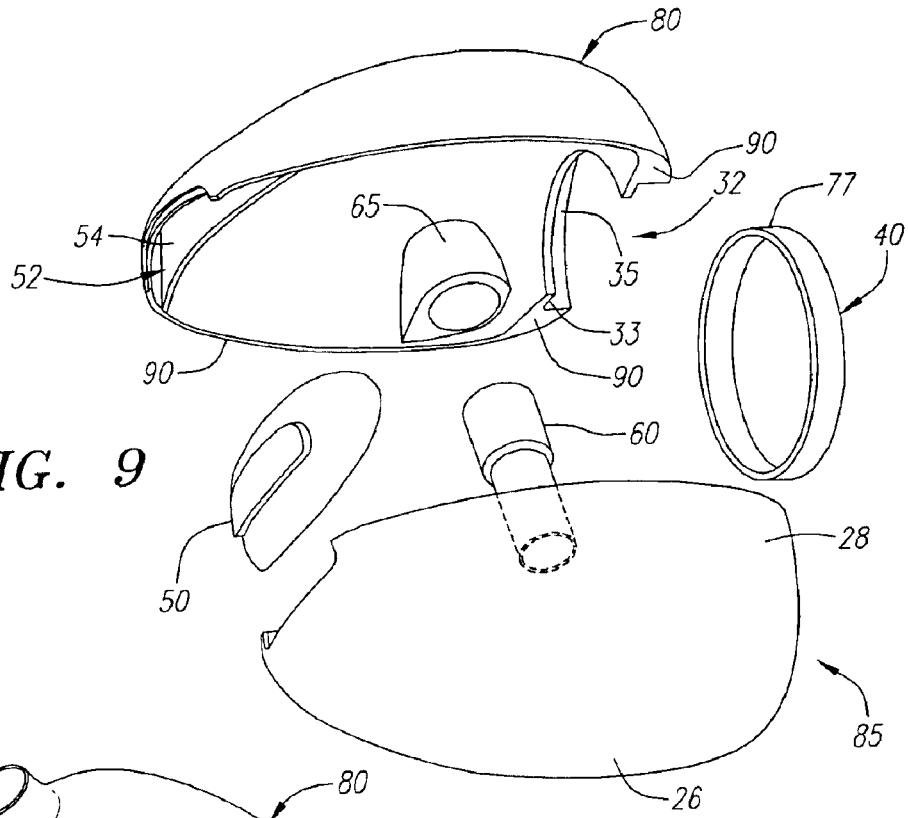
FIG. 9 is an exploded bottom perspective view of a preferred embodiment of the golf club of the present invention.
Figure 10:
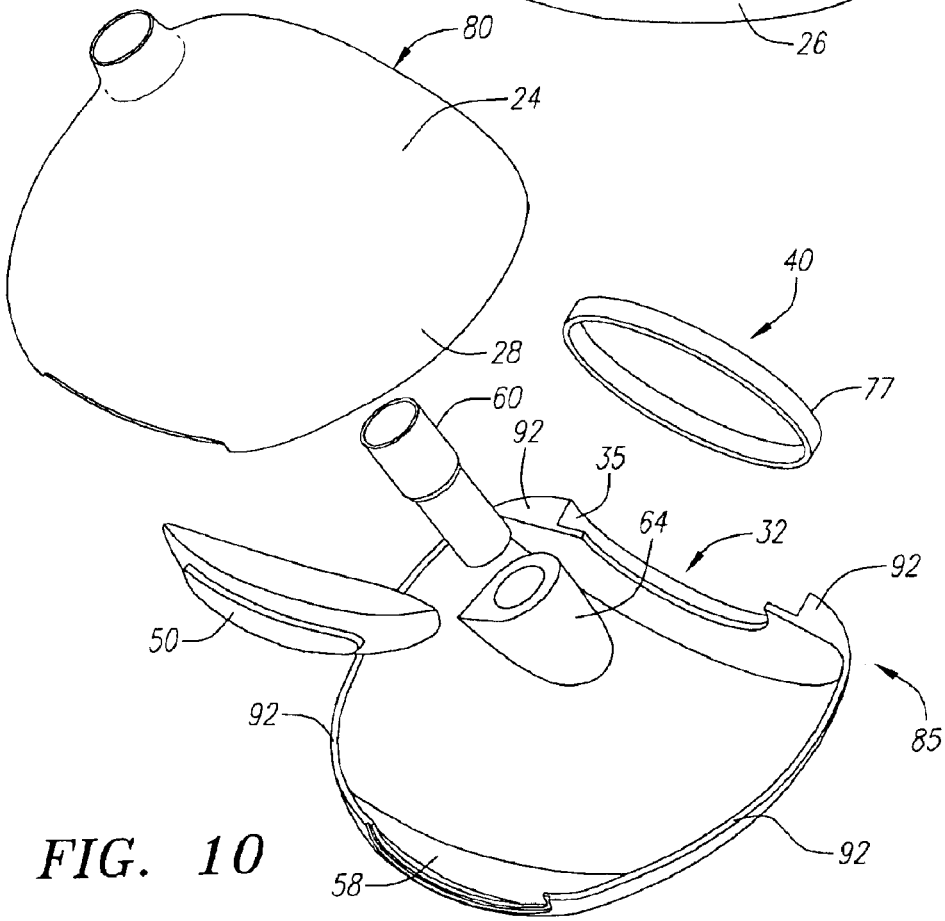
FIG. 10 is an exploded top perspective view of a preferred embodiment of the golf club of the present invention.

FIGS. 9 and 10 best illustrate the hollow interior 34 of the club head 20. As shown in FIGS. 9 and 10, the recessed portion 33 of the front wall 30 encompasses the opening 32 forming a support for placement and attachment of the striking plate insert 40 thereon. The front wall 30 has a shoulder 35 that preferably engages a perimeter 77 of the striking plate insert 40. The thickness of the recessed portion 33 of the front wall 30 is preferably thicker than the crown 24, the sole 26 or the ribbon 28.

Also shown in FIGS. 9 and 10 is the hosel 60, which is disposed within the hollow interior 34, and is located near the heel end 36 of the golf club head 20. The hosel 60 is preferably composed of an aluminum material, and preferably has a mass ranging from 3 to 10 grams, more preferably from 4 to 8 grams, and most preferably has a mass of 6 grams. Alternatively, the hosel 60 is composed of a steel or steel alloy material, and preferably has a mass ranging from 10 grams to 15 grams, and most preferably 13 grams. Alternatively, the hosel 60 is composed of a strong polymer material such as a urethane or ABS material. In a preferred embodiment, a shaft, not shown, is disposed within a hosel insert, not shown, that is disposed within the hosel 60 through the crown bore 62. Such a hosel insert is described in U.S. Pat. No. 6,352,482, filed on Aug. 31, 2000, entitled Golf Club With Hosel Liner, which pertinent parts are hereby incorporated by reference. The hosel 60 is preferably positioned in a hosel lower base 64 and a hosel upper base 65, and extends from the sole 26 to the crown 24. Alternatively, the golf club head 20 has an external hosel which projects upward from the heel end 36 of the crown 24.

Figure 3:
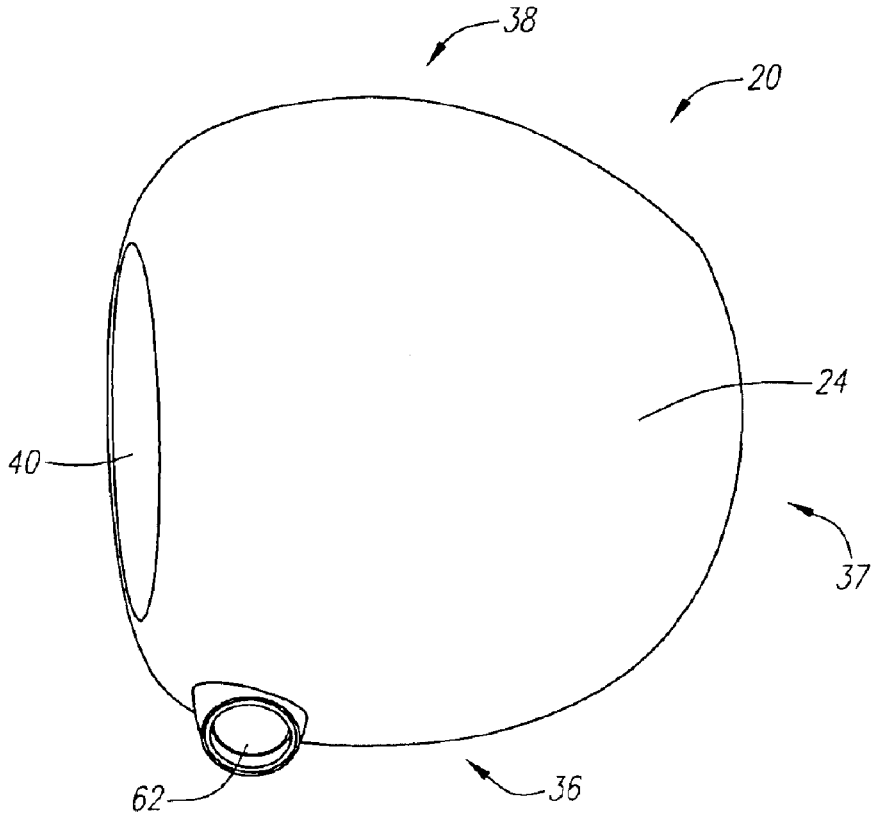
FIG. 3 is a top plan view of the golf club head of FIG. 1.
Figure 4:
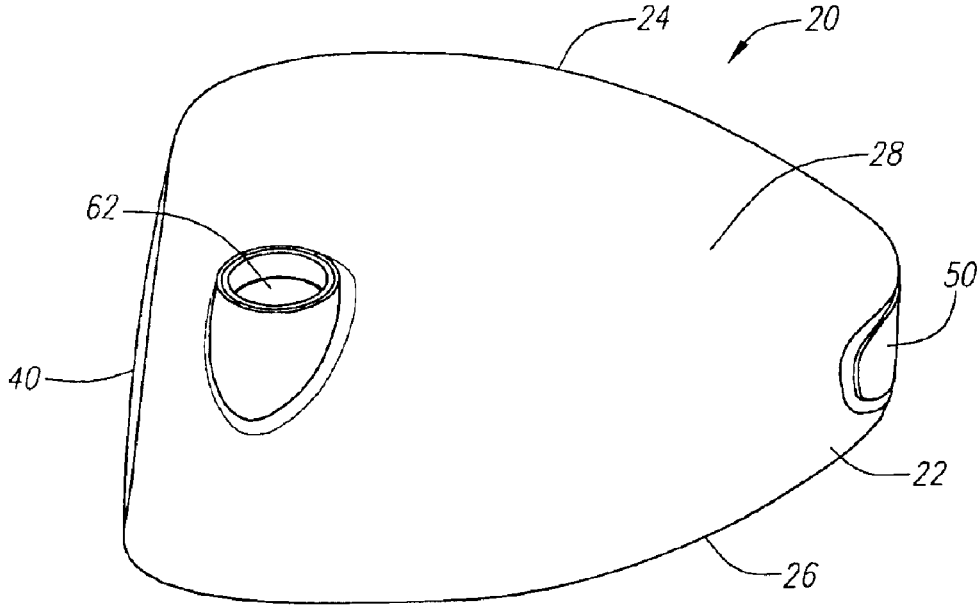
FIG. 4 is heel side view of the golf club head of FIG. 1.

Also shown in FIGS. 9 and 10 are the walls of the aft recess 52. The aft recess 52 preferably extends into the hollow interior 34. The aft recess 52 is preferably defined by upper recess wall 54 and lower recess wall 58. The rear weighting member 50 is positioned within the aft recess 52, as best shown in FIG. 3.

The rear weighting member 50 is preferably composed of a metal material such as a spin cast pewter, steel, steel alloys, brass, tungsten, tungsten alloys, or other high density materials. The rear weighting member 50 is preferably co-molded with a body 22 or press-fitted within the aft recess 52 subsequent to fabrication of the body 22. In another attachment process, the rear weighting member 50 is bonded within the aft recess 52 using an adhesive. The adhesive is placed on the exterior surface of the walls 54 and 58 that define the aft recess 52. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention. Yet in another attachment process, the rear weighting member 50 is mechanically secured within the aft recess 52. Those skilled in the pertinent art will recognize other methods for attachment of the rear weighting member 50 within the aft recess 52 without departing from the scope and spirit of the present invention.

FIGS. 9 and 10 also illustrate a preferred manufacturing method for the golf club head 20 of the present invention. The preferred method utilizes a first body 80 and a second body 85. Preferably, the first body 80 is composed of the crown 24, part of the ribbon 28, part of the front wall 30, part of the opening 32 and part of the aft recess 52. Preferably, the second body 85 is composed of the sole 26, part of the ribbon 28, part of the front wall 30, part of the opening 32 and part of the aft recess 52. Preferably the first body has a first edge 90 and the second body 85 has a second edge 92. Preferably, the first edge 90 and second edge 92 are aligned and bonded together using an adhesive, such as disclosed above, if the body 22 is composed of a metal such as a magnesium alloy or aluminum alloy. In such a fabrication process, the rear weighting member 50 and the striking plate insert 40 may be fitted and attached during the bonding process.

In the embodiment illustrated in FIGS. 11–18, the front wall has an opening 32 with a width, "Wo", ranging preferably from 2.5 inches to 4.0 inches, and most preferably having a width, Wo, of 3.4 inches. Also, the opening has a height, "Ho", preferably ranging from 1.5 inches to 2.7 inches, and most preferably 2.0 inches. The striking plate insert 40 preferably has equal dimensions for height and width.

Figure 16:
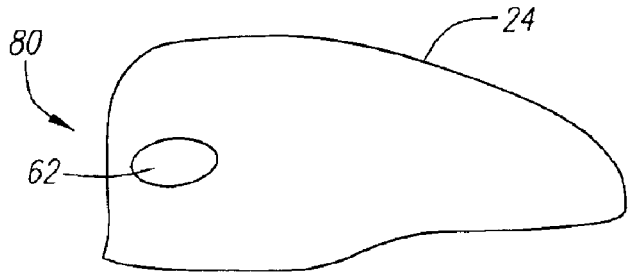
FIG. 16 is an isolated side view of a first body of the golf club head of FIG. 11.
Figure 16A:
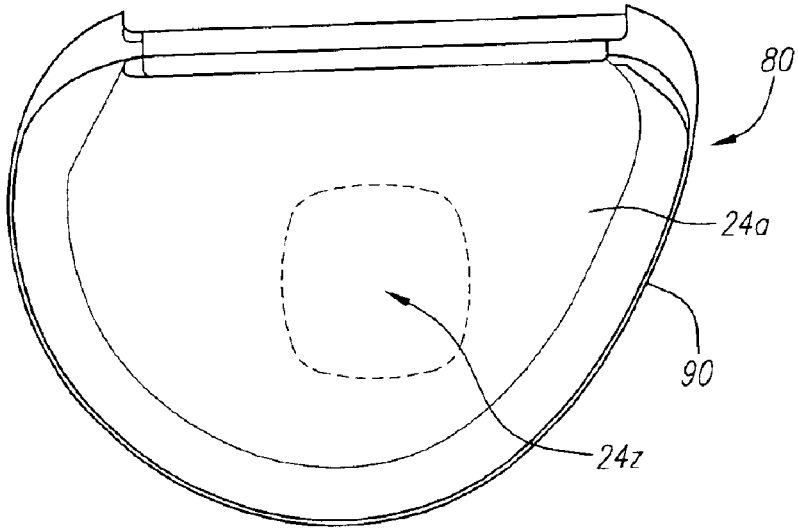
FIG. 16A is a bottom plan view of the first body of FIG. 16.
Figure 16B:
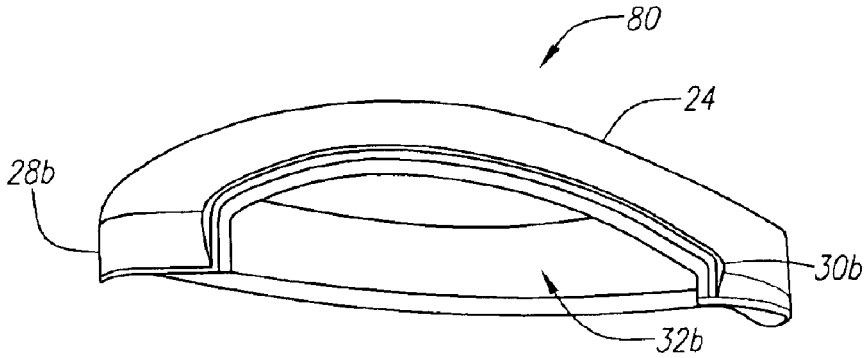
FIG. 16B is a front view of the first body of FIG. 16.

As shown in FIGS. 16, 16A and 16B, the first body 80 preferably includes a crown 24, an upper front wall 30*b*, an upper opening 32*b* and an upper ribbon 28*b*. The crown 24 preferably has a thickened portion 24*z* that has a thickness greater than the entirety of the crown 24. In a preferred embodiment, the thickened portion 24*z* is thicker than the entirety of the crown 24 by 0.010 inch to 0.050 inch. For example, the thickened portion 24*z* has a thickness of 0.055 inch and the entirety of the crown 24 has a thickness of 0.040 inch. Preferably, the first body 80 of this embodiment is composed of the magnesium alloy AZ-91-D (nominal composition of magnesium with aluminum, zinc and manganese).

Figure 17:
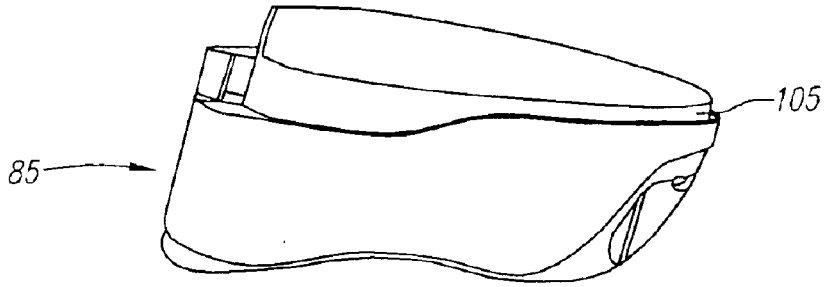
FIG. 17 is an isolated side view of a second body of the golf club head of FIG. 11.
Figure 17A:
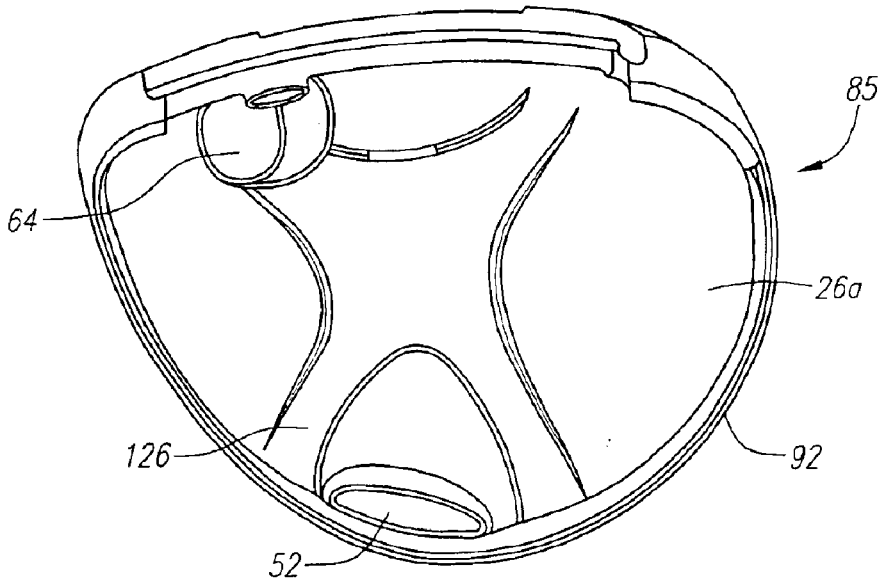
FIG. 17A is a bottom plan view of the second body of FIG. 17.
Figure 17B:
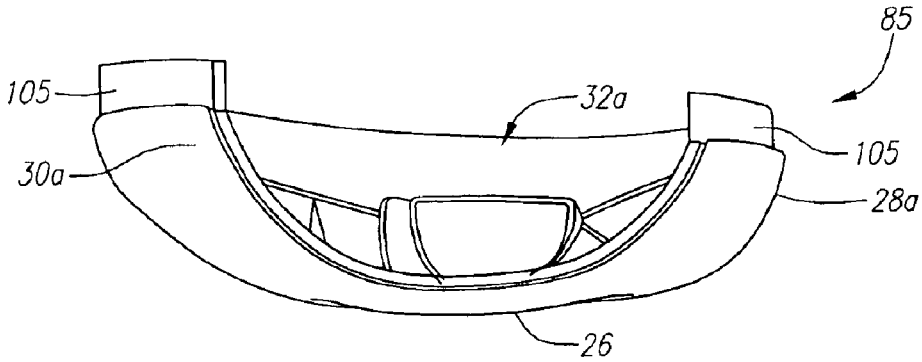
FIG. 17B is a front view of the second body of FIG. 17.
Figure 19:
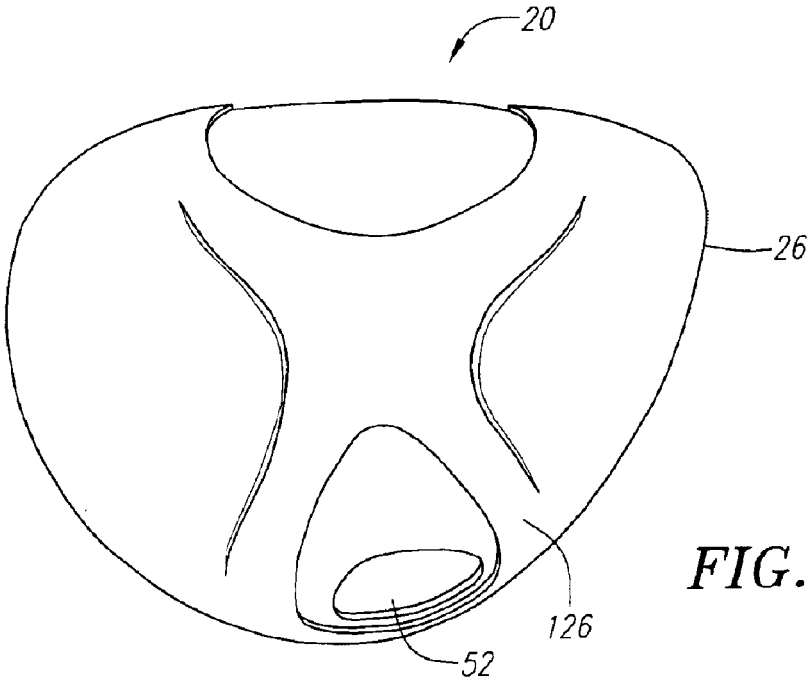
FIG. 19 is a bottom plan view of the golf club head of FIG. 11.

As shown in FIGS. 17, 17A and 17B, the second body 85 preferably includes a sole 26, a lower front wall 30*a*, a lower opening 32*a*, a lower ribbon 28*a* and the aft recess 52. Further, the second body 85 includes an inner wall 105. An interior sole surface 26*a* is shown in FIG. 17A and a hosel base 64 extends upward from the interior sole surface 26*a*. Preferably; the second body 85 of this embodiment is composed of the magnesium alloy AM-60-B (nominal composition of magnesium with aluminum and manganese). As shown in FIG. 19, the sole 26 of this embodiment has a medial ridge 126 which is illustrated in FIG. 17A as a depression of the interior sole surface 26*a*.

Figure 15:
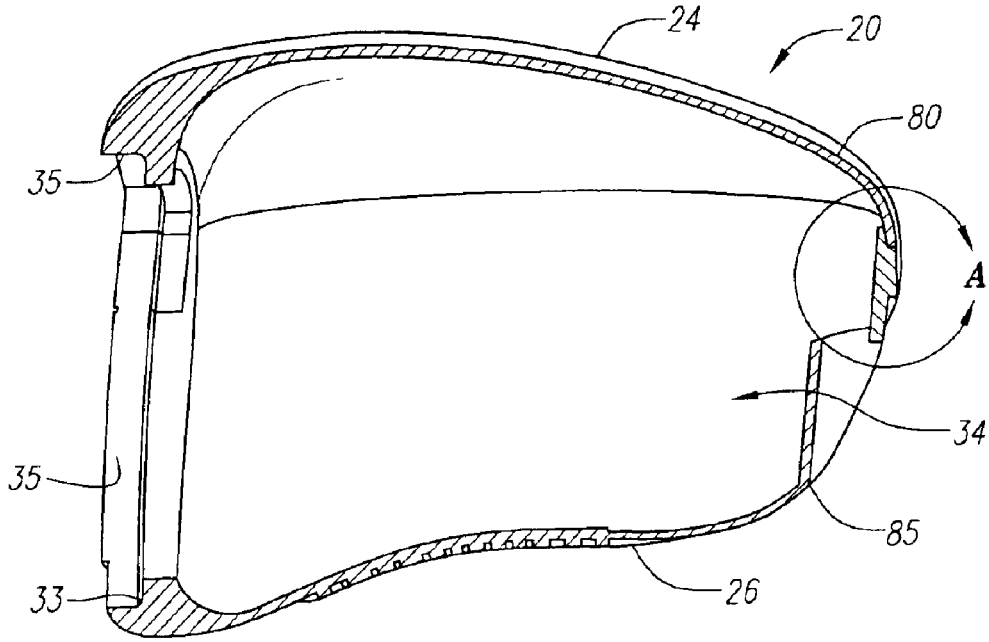
FIG. 15 is a cross-sectional view along line 15—15 of the golf club head of FIG. 14.
Figure 15A:
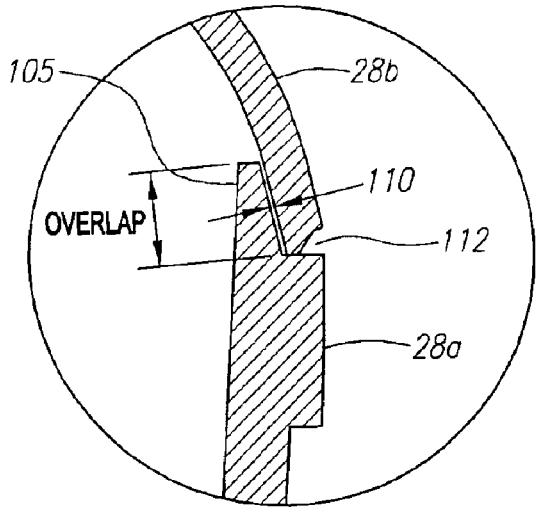
FIG. 15A is an enlarged view of circle A of FIG. 15.
Figure 18:
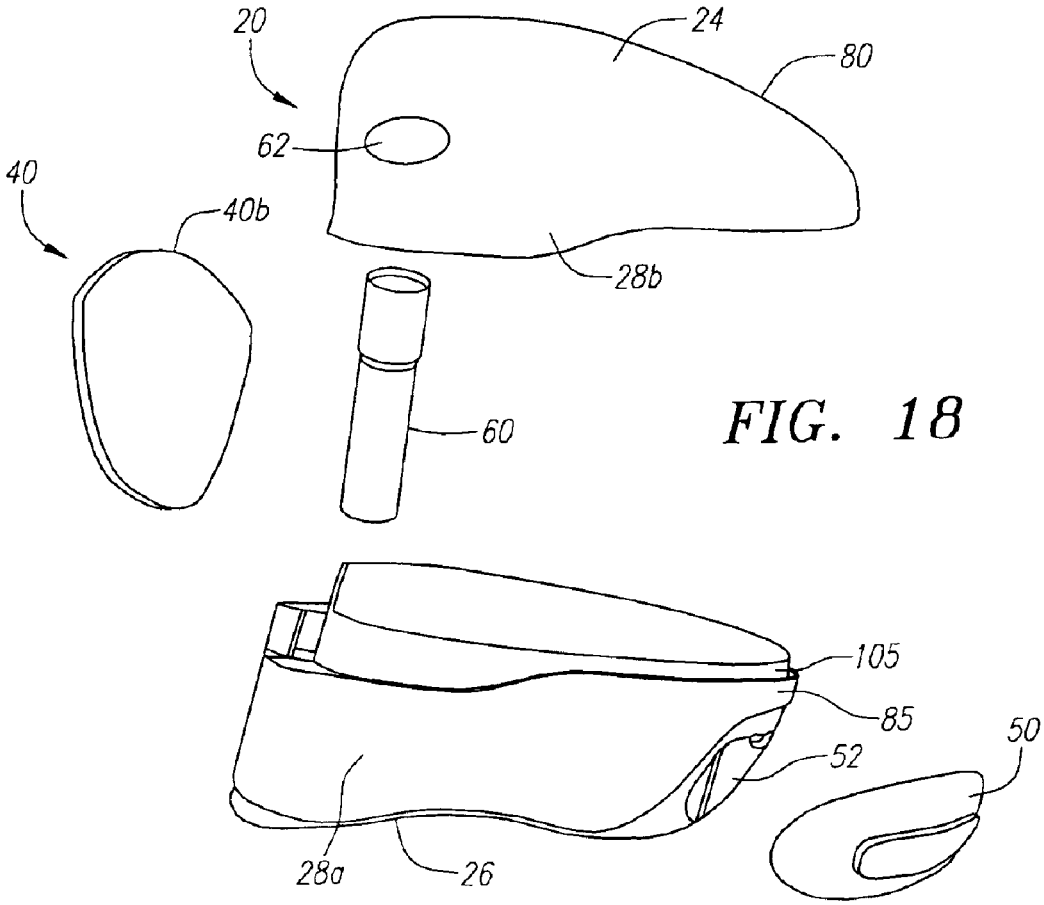
FIG. 18 is an exploded side view of the golf club of FIG. 11.

As illustrated in FIG. 18, the first body 80 is aligned with and the bonded to the second body 85. The inner wall 105 of the second body 85 is placed within the first body 80, as shown in FIG. 15A. The overlap of the inner wall 105 and the first body preferably ranges from 0.070 inch to 0.150 inch, more preferably from 0.090 inch to 0.120 inch, and is most preferably 0.106 inch. The bond gap 110 between the inner wall 105 and an interior surface of the first body 80 preferably ranges from 0.002 inch to 0.025 inch, more preferably from 0.005 inch to 0.010 inch, and most preferably is 0.007 inch. The edge 90 of the first body has an optional relief groove 112. Preferably, an adhesive, such as disclosed above, is applied to the edges 90 and 92 of the first body 80 and the second body 85, and also applied to the outer surface of the inner wall 105 for bonding the first body 80 to the second body 85.

The present invention is directed at a golf club head that has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head 20 having a coefficient of restitution preferably ranging from 0.70 to 0.94, as measured under conventional test conditions.

The coefficient of restitution of the club head 20 of the present invention under standard USGA test conditions with a given ball preferably ranges from approximately 0.80 to 0.94, more preferably ranges from 0.82 to 0.89 and is most preferably 0.86.

The volume of the club head 20 of the present invention ranges from 250 cubic centimeters to 600 cubic centimeters, and more preferably ranges from 330 cubic centimeters to 500 cubic centimeters, even more preferably 360 cubic centimeters to 450 cubic centimeters, and most preferably 420 cubic centimeters. The volume of the golf club head 20 will also vary between fairway woods (preferably ranging from 3-woods to eleven woods) with smaller volumes and drivers, which will have larger volumes than the fairway woods.

The mass of the club head 20 of the present invention preferably ranges from 165 grams to 300 grams, more preferably ranges from 175 grams to 250 grams, even preferably from 190 grams to 225 grams, and most preferably 196 grams. Preferably, the striking plate insert 40 has a mass ranging from 40 grams to 90 grams, more preferably ranging from 50 grams to 80 grams, yet more preferably from 55 grams to 75 grams, and most preferably 65 grams. The body 22 (without weighting) has a mass preferably ranging from 30 grams to 100 grams, more preferably from 40 grams to 90 grams, even more preferably 60 grams to 80 grams, and most preferably 70 grams. The aft weighting member 50 has a mass preferably ranging from 30 grams to 90 grams, more preferably from 40 grams to 70 grams, and most preferably 55 grams. The hosel 60 preferably has a mass ranging from 10 to 15 grams, and most preferably has a mass of 13 grams. Additionally, epoxy, or other like flowable materials, in an amount ranging from 0.5 grams to 5 grams, may be injected into the hollow interior 34 of the golf club head 20 for selective weighting thereof.

Figure 5:
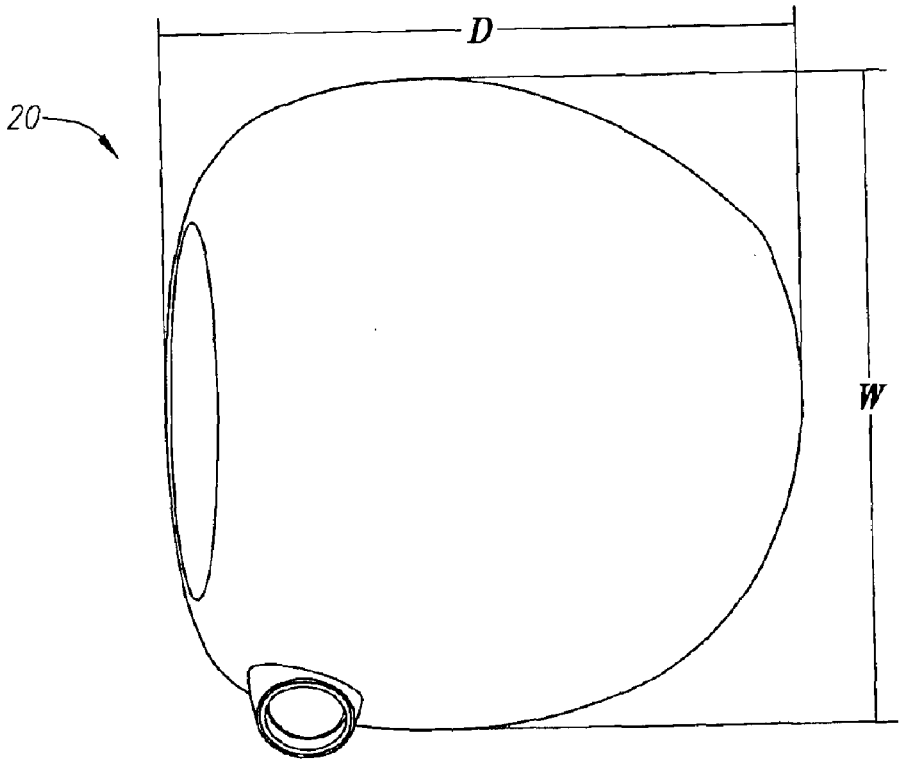
FIG. 5 is a top plan view of the golf club head of FIG. 1 illustrating the width and depth of the golf club head.
Figure 6:
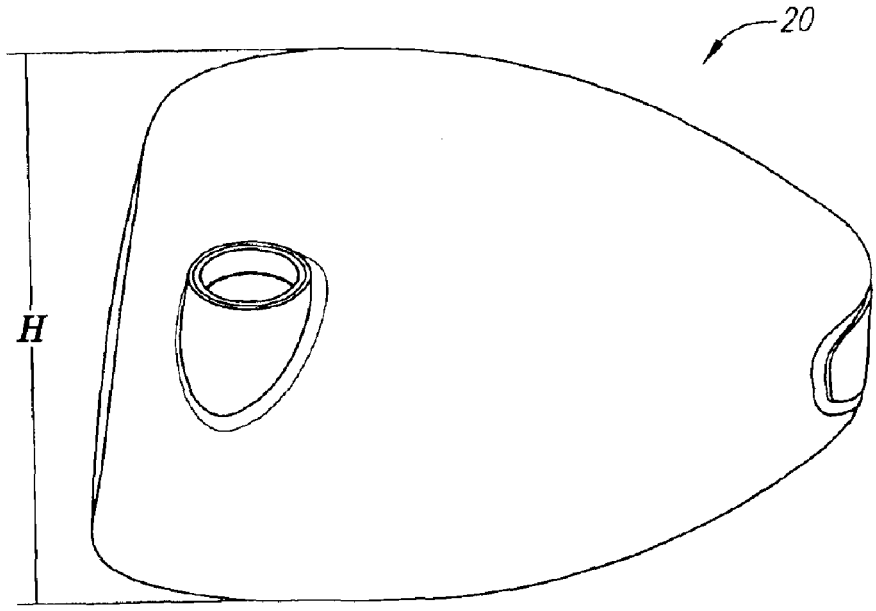
FIG. 6 is heel side view of the golf club head of FIG. 1 illustrating the height of the golf club head.
Figure 11:
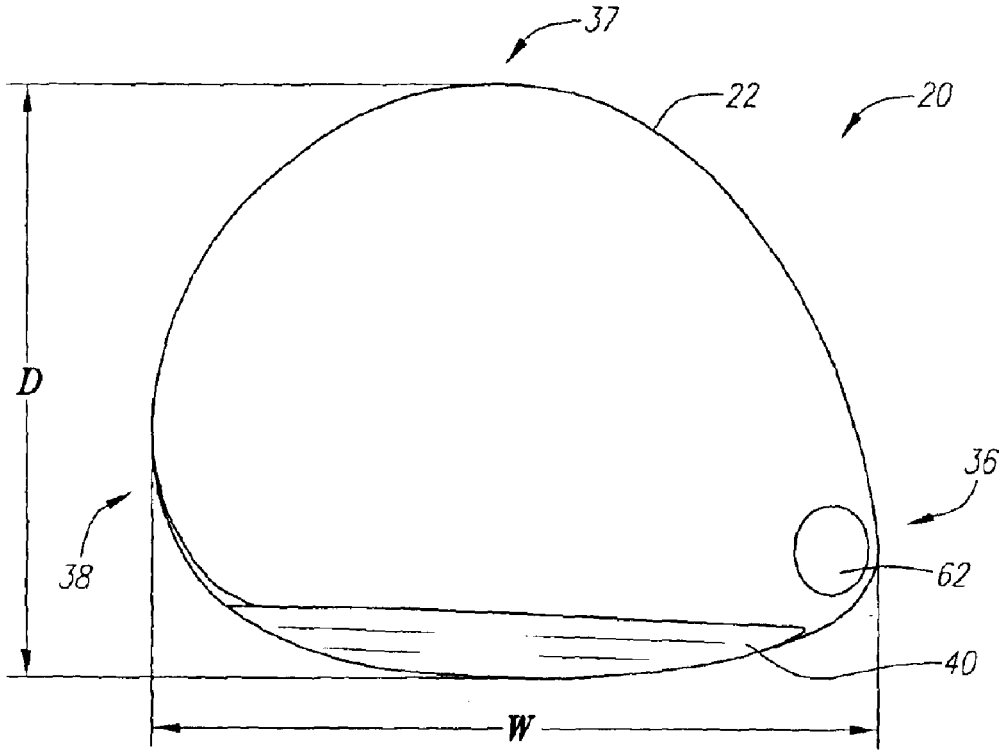
FIG. 11 is a top plan view of an alternative embodiment of the golf club head of the present invention.
Figure 12:
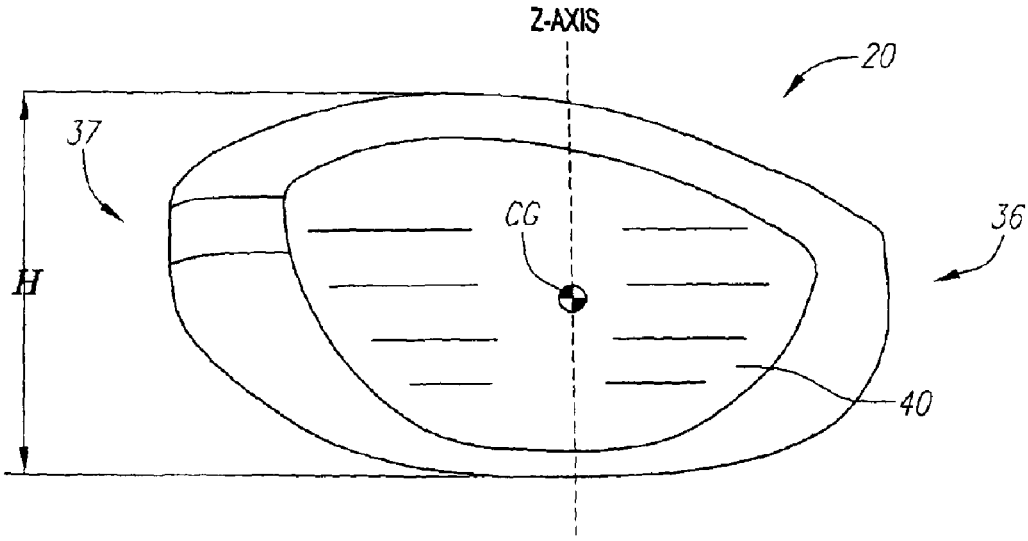
FIG. 12 is a front view of the golf club head of FIG. 11.
Figure 13:
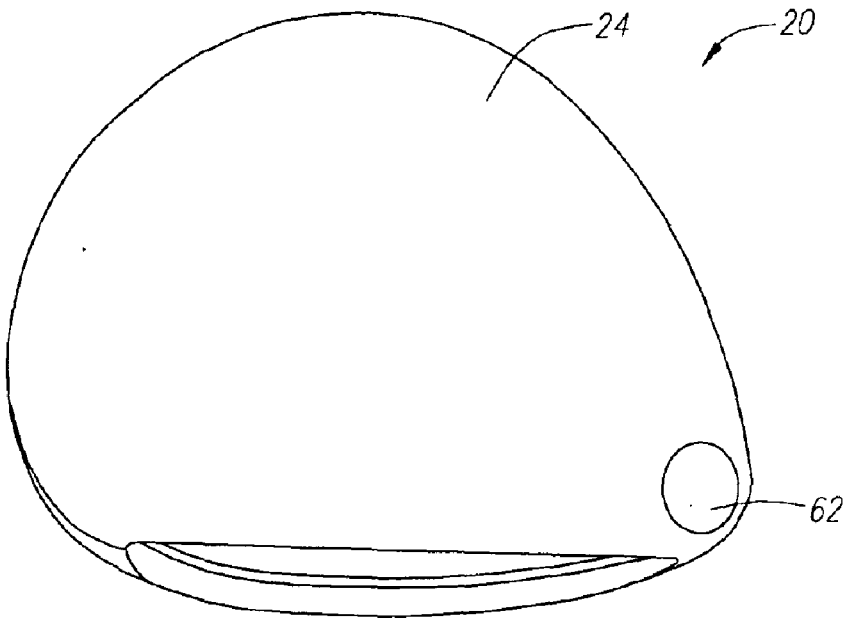
FIG. 13 is a top plan view of the golf club head of FIG. 11 without a striking plate insert.
Figure 14:
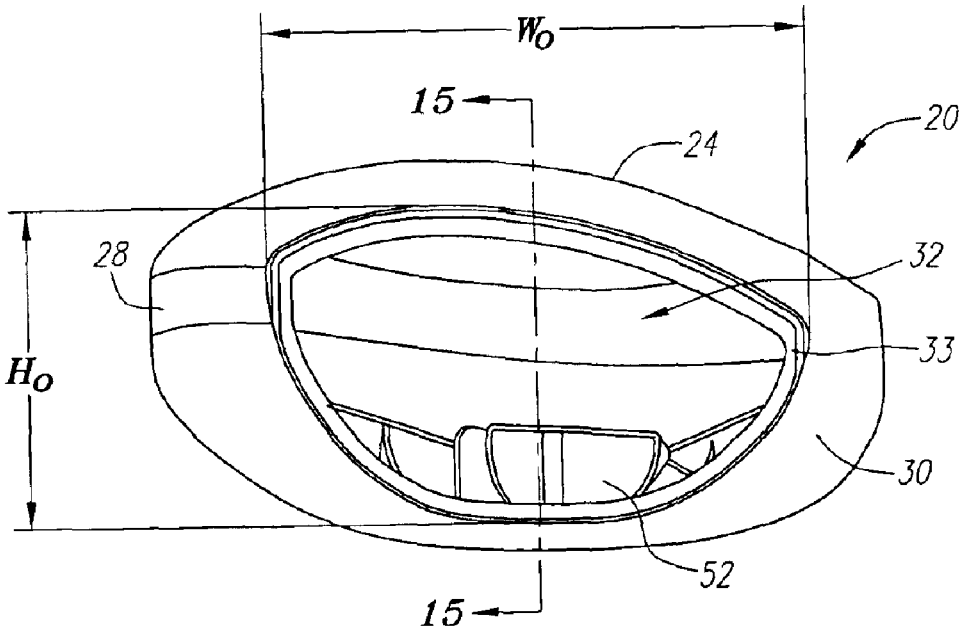
FIG. 14 is a front view of the golf club head of FIG. 13.

As shown in FIGS. 5 and 6 for the first embodiment and FIGS. 11 and 12 for the second embodiment, the depth, "D", of the club head 20 from the striking plate insert 40 to the aft end 37 of the crown 24 preferably ranges from 3.0 inches to 4.5 inches, and is most preferably 3.74 inches. The height, "H", of the club head 20, as measured while in address position from the sole 26 to the crown 24, preferably ranges from 2.0 inches to 3.5 inches, and is most preferably 2.62 inches. The width, "W", of the club head 20 from the toe end 38 to the heel end 36 preferably ranges from 4.0 inches to 5.5 inches, and more preferably 4.57 inches. As shown in FIG. 1, the height, "h", of the striking plate insert 40, preferably ranges from 1.8 inches to 2.5 inches, and is most preferably 2.08 inches. The width, "w", of the striking plate insert from the toe end to the heel end preferably ranges from 3.0 inches to 5.0 inches, and more preferably 3.52 inches. In a preferred embodiment, has an aspect ratio such as disclosed in U.S. Pat. No. 6,569,033 which is hereby incorporated by reference in its entirety.

Figure 7:
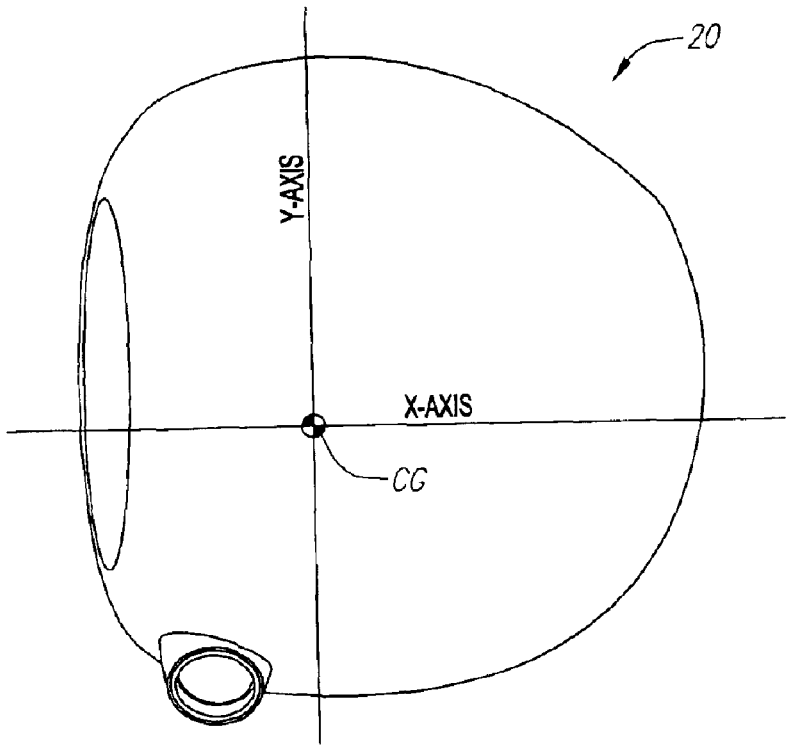
FIG. 7 is a top plan view of the golf club head of FIG. 1 illustrating the X-axis and the Y-axis through the center of gravity of the golf club head.
Figure 8:
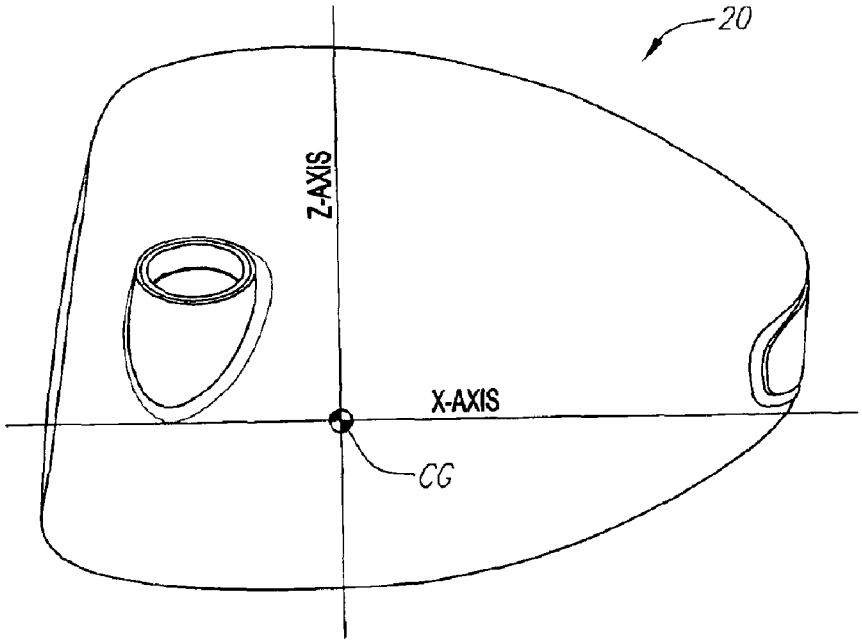
FIG. 8 is heel side view of the golf club head of FIG. 1 illustrating the Z-axis and the X-axis through the center of gravity of the golf club head.

FIGS. 7 and 8 illustrate the axes of inertia through the center of gravity of the golf club head. The axes of inertia are designated X, Y and Z. The X axis extends from the striking plate insert 40 through the center of gravity, CG, and to the rear of the golf club head 20. The Y axis extends from the toe end 38 of the golf club head 20 through the center of gravity, CG, and to the heel end 36 of the golf club head 20. The Z axis extends from the crown 24 through the center of gravity, CG, and to the sole 26.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame (,$X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Morrient Of Inertia Composite Golf Club, and hereby incorporated by reference in its entirety. If a shaft is present, it is removed and replaced with a hosel cube that has a multitude of faces normal to the axes of the golf dub head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention will range from 2800 g-$cm^2$ to 5000 g-$cm^2$, preferably from 3000 g-$cm^2$ to 4500 g-$cm^2$, even more preferably from 3200 g-$cm^2$ to 4000 g-$cm^2$, and most preferably 3758 g-$cm^2$. The moment of inertia, Iyy, about the Y axis for the golf club head 20 of the present invention will range from 1500 g-$cm^2$ to 4000 g-$cm^2$, preferably from 2500 g-$cm^2$ to 3400 g-$cm^2$, even preferably from 2900 g-$cm^2$ to 3100 g-$cm^2$, and most preferably 3003 g-$cm^2$.

Further, the golf club head 20 of the present invention preferably has good products of inertia such as disclosed in U.S. Pat. No. 6,425,832, which was filed on Jul. 26, 2001 and is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a first half body and a second half body, the first half body comprising a crown, a downwardly depending front wall with an upper opening defined in the lower periphery of the upper front wall, and an upper ribbon, the second body comprising a sole, an upwardly depending lower front wall with a lower opening defined in the upper periphery of the lower front wall, a lower ribbon with an exterior recess opposite the lower opening, the first body being aligned with and bonded to the second body with the upper opening and the lower opening forming an opening in the body, the body composed of a first metal material selected from the group consisting of magnesium alloys, aluminum alloys, magnesium and aluminum;

a striking plate insert positioned within the opening, the striking plate insert having a thickness in the range of 0.040 inch to 0.250 inch, the striking plate insert composed of a second metal material and having a mass ranging from 60 grams to 100 grams; and a weighting member positioned within the exterior recess of the lower ribbon, the weighting member having a mass ranging from 5 grams to 40 grams and composed of a third metal material;

wherein the golf club head has a volume ranging from 30 cubic centimeters to 500 cubic centimeters.

2. The golf club head according to claim 1 wherein the striking plate insert is composed of a formed metal material.

3. The golf club head according to claim 1 wherein striking plate insert is composed of a material selected from the group consisting of a forged metal material, a formed metal material, a machined metal material and a cast metal material.

4. The golf club head according to claim 1 wherein the body has a mass ranging from 50 grams to 110 grams.

5. The golf club head according to claim 1 wherein the moment of inertia about an Izz axis of the golf club head is greater than 3000 g-cm$^2$.

6. The golf club head according to claim 1 wherein the striking plate insert is composed of a material selected from the group consisting of titanium, titanium alloy, steel alloys and amorphous metals.

7. The golf club head according to claim 1 wherein the weighting member is composed of a material selected from the group consisting of spin east pewter, steel, brass, tungsten, copper, a steel alloy, a tungsten alloy and a copper alloy.

8. A golf club head comprising:

a body comprising a first half body and a second half body, the first body comprising a crown, a downwardly depending front wall with an upper opening defined in the lower periphery of the upper front wall, and an upper ribbon, the second body comprising a sole, an upwardly depending lower front wall with a lower opening defined in the upper periphery of the lower front wall, a lower ribbon, the first body being aligned with and bonded to the second body with the upper opening and the lower opening forming an opening in the body, the body composed of a first metal material selected from the group consisting of magnesium alloys, aluminum alloys, magnesium and aluminum;

a striking plate insert positioned within the opening, the striking plate insert having a thickness in the range of 0.040 inch to 0.250 inch the striking plate insert composed of a second metal material and having a mass ranging from 60 grams to 100 grams; and a weighting member positioned within the exterior recess of the lower ribbon, the weighting member having a mass ranging from 5 grams to 40 grams and composed of a third metal material;

wherein the golf club head has a coefficient of restitution of 0.70 to 0.94, and the golf club head has a volume ranging from 330 cubic centimeters to 500 cubic centimeters;

wherein the moment of inertia about the Izz axis through the center of gravity is greater than 3000 g-cm$^2$, and the moment of inertia about the Iyy axis through the center of gravity is greater than 1900 g-cm$^2$.

9. A golf club head comprising:

a body comprising a first half body and a second half body, the first body comprising a crown, a downwardly depending front wall with an upper opening defined in the lower periphery of the upper front wall, and an upper ribbon, the second body comprising a sole, an upwardly depending lower front wall with a lower opening defined in the upper periphery of the lower front wall, a lower ribbon, the first body being aligned with and bonded to the second body with the upper opening and the lower opening forming an opening in the body, the body composed of a metal material selected from the group consisting of magnesium alloys, aluminum alloys, magnesium and aluminum;

a striking plate insert positioned within the opening, the striking plate insert having a thickness in the range of 0.040 inch to 0.250 inch the striking plate insert composed of a steel alloy material and having a mass ranging from 60 grams to 100 grams; and a weighting member positioned within the exterior recess of the lower ribbon, the weighting member having a mass ranging from 30 grams to 60 grams and composed of a tungsten alloy material;

wherein the golf club head has a volume ranging from 320 cubic centimeters to 450 cubic centimeters, the golf club head ha a mass ranging from 190 grams to 225 grams, the moment of inertia about the Izz axis through the center of gravity is greater than 3000 g-cm$^2$, and the moment of inertia about the Iyy axis through the center of gravity is greater than 1900 g-cm$^2$.

10. A golf club head comprising:

a body comprising a first half body and a second half body, the first body comprising a crown, a downwardly depending front wall with an upper opening defined in the lower periphery of the upper front wall, and an upper ribbon, the second body comprising a sole, an upwardly depending lower front wall with a lower opening defined in the upper periphery of the lower front wall, a lower ribbon, the first body being aligned with and bonded to the second body with the upper opening and the lower opening forming an opening in the body, the body composed of a first metal material selected from the group consisting of magnesium alloys, aluminum alloys, magnesium and aluminum; and a striking plate;

wherein the golf club head has a volume less than 450 cubic centimeters, a mass ranging from 190 grams to 225 grams, wherein the moment of inertia about the Izz axis through the center of gravity is greater than 3000 g-cm$^2$, and the moment of inertia about the Iyy axis through the center of gravity is greater than 3000 g-cm$^2$.

11. The golf club head according to claim 10 wherein the first half-body and the second half-body arc composed of a metal material selected from the group consisting of magnesium alloys, aluminum alloys, magnesium and aluminum, and the striking plate insert is composed of a metal material.

12. A golf club head comprising:

a body comprising a first half body and a second half body, the first body comprising a crown, a downwardly depending front wall with an upper opening defined in the lower periphery of the upper front wall, and an upper ribbon, the second body comprising a sole, an upwardly depending lower front wall with a lower opening defined in the upper periphery of the lower front wall, a lower ribbon, the first body being aligned with and bonded to the second body with the upper opening and the lower opening forming an opening in the body, the body composed of a metal material selected from the group consisting of magnesium alloys, aluminum alloys, magnesium and aluminum;

a striking plate insert positioned within the opening, the striking plate insert having a thickness in the range of 0.040 inch to 0.250 inch the striking plate insert composed of a steel alloy material and having a mass ranging from 60 grams to 100 grams; and a weighting member positioned within the exterior recess of the lower ribbon, the weighting member having a mass ranging from 30 grams to 60 grams and composed of a tungsten alloy material;

wherein the golf club head has a coefficient of restitution of 0.82 to 0.89, and the golf club head has a volume ranging from 350 cubic centimeters to 450 cubic centimeters, the golf club head having a mss ranging from 190 grams to 225 grams, wherein the moment of inertia about the Izz axis through the center of gravity is greater than 3000 g-cm$^2$, and the moment of inertia about the Iyy axis through the center of gravity is greater than 3000 g-cm$^2$.

* * * * *